US005322632A

United States Patent [19]

Gambini et al.

[11] Patent Number: 5,322,632

[45] Date of Patent: Jun. 21, 1994

[54] MULTIFUNCTIONAL ADDITIVE FOR LUBRICATING OILS

[75] Inventors: Paola Gambini, Milan; Paolo Koch, Melegnano; Alberto Santambrogio, Corsico, all of Italy

[73] Assignee: Ministero Dell 'Universita' E Della Ricerca Scientific e Technologica, Rome, Italy

[21] Appl. No.: 805,007

[22] Filed: Dec. 11, 1991

[30] Foreign Application Priority Data

Dec. 14, 1990 [IT] Italy ..... 22396 A/90

[51] Int. Cl.[5] ..... C10M 145/14; C10M 149/06

[52] U.S. Cl. ..... 252/51.005 A; 252/401; 526/312; 525/327.1; 525/375

[58] Field of Search ..... 252/11, 21, 28, 51.5 A, 252/401; 525/327.1, 375; 526/312

[56] References Cited

U.S. PATENT DOCUMENTS 3,304,260 2/1967 Fields et al. ..... 252/51.5 A
3,816,314 6/1974 Pappas et al. ..... 252/51.5 A
3,864,099 2/1975 Ek .
4,036,768 7/1977 Crawford et al. ..... 252/51.5 A
4,941,985 7/1990 Benfaremo et al. .
5,013,468 5/1991 Benfaremo .
5,157,088 10/1992 Dishong et al. ..... 252/51.5 A
5,169,550 12/1992 Sanderson et al. ..... 252/52 R

*Primary Examiner*—Jacqueline V. Howard
*Attorney, Agent. or Firm*—George P. Hoare, Jr.

[57] ABSTRACT

A lubricating oil viscosity index improvement additive with dispersant and antioxidant properties of general formula:

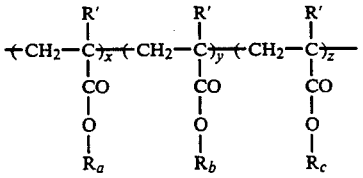

(I)

where R' is hydrogen or an alkyl, $R_a$ and $R_b$ are alkyl radicals, $R_c$ is a nitrogenated alkyl radical and x, y and z represent relative quantities. The invention also relates to the process for preparing said additive and lubricating oil compositions which contain it.

8 Claims, No Drawings

MULTIFUNCTIONAL ADDITIVE FOR LUBRICATING OILS

This invention relates to a lubricating oil viscosity index improver (V.I.I) with dispersant and antioxidant properties.

It is known in the art to add to lubricating oils an oil-soluble polymer (V.I.I) able to improve their rheological behaviour on temperature variation, such as a polymer or copolymer of an acrylic or methacrylic alkyl ester containing a number of carbon atoms in the alkyl group such as to make it oil-soluble.

It is also known beneficially in the art to introduce into said oil-soluble polymer a copolymerizable monomer containing nitrogen to give the resultant product dispersion characteristics in addition to viscosity index improvement. Said copolymerizable monomer containing nitrogen, also known as a dispersant monomer, is generally chosen from vinylimidazoles, vinyl pyrrolidones, vinylpyridines and N,N-dialkyl-aminoethylmethacrylates. This practice is described for example in British patents 1,272,161 and 1,333,733, U.S. Pat. No. 3,732,334 and Belgian patent 874,068.

V.I.I copolymers with simultaneous dispersant and antioxidant characteristics are also known, for use in internal combustion engines to reduce sludge formation and reduce lubricating oil oxidation during engine operation.

For example, U.S. Pat. No. 4,699,723 describes ethylene-propylene copolymers grafted with monomers containing a nitrogen atom and a sulphur atom, such as 4-methyl-5-vinylthiazole, possessing dispersant and antioxidant characteristics in addition to viscosity index improvement.

The use of these polymers, normally defined as multifunctional, also improves the performance of specific additives contained in the lubricating oil (for example antiwear additives such as zinc dithiophosphates, dispersants such as polyisobutenyl succinimides, detergents such as calcium sulphonates, antioxidants such as sterically hindered phenols, etc.) and possibly reduces their required quantity.

The present invention provides sulphur-free polymeric additives for lubricating oils which effectively improve their viscosity index while possessing dispersant and antioxidant properties. A simple and convenient method has also been found for preparing said additives.

In accordance therewith, the present invention firstly provides a polymeric viscosity index improvement additive with dispersant and antioxidant properties of general formula:

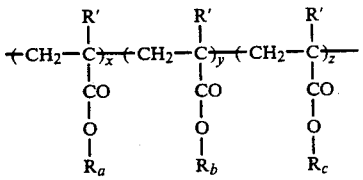

(I)

derived from copolymerization of unsaturated esters, said general formula (I) representing the type and quantity of reactive monomers but not their arrangement within the final polymer chain, where R', which can be identical or different, are hydrogen atoms or alkyl radicals;

$R_a$ is an alkyl radical or a mixture of linear or branched alkyl radicals with between 6 and 25 carbon atoms;

$R_b$ is an alkyl radical with between 1 and 4 carbon atoms or is identical to $R_a$;

$R_c$ consists of one or more linear, branched or cyclic alkyl radicals with 1 or 2 nitrogen atoms and between 4 and 20 carbon atoms;

x, y and z represent the weight percentages of the various polymerizable monomer units, x being between 80 and 95%, y being between 0 and 12% and z being between 2 and 8%.

According to a preferred embodiment of the present invention:

x is between 85 and 90%, y is between 3 and 7% and z is between 4 and 6% by weight;

R' is a methyl radical, all the polymerizable esters represented by formula (I) therefore being methacrylates;

$R_a$ represents alkyl groups derived from mixtures of natural or synthetic linear or branched primary alcohols with between 10 and 20 carbon atoms;

$R_b$ is a methyl radical;

$R_c$ is the radical of 2,2,6,6-tetramethyl-piperidin-4-ol, the polymerizable monomer $CH_2{=}CR'{-}COOR_c$ therefore being 2,2,6,6-tetramethyl-piperidin-4-ol methacrylate.

In a further preferred embodiment of the present invention the $R_c$ methacrylate is a mixture of:

50–85 wt % of 2,2,6,6-tetramethyl-piperidin-4-ol methacrylate,

15–50 wt % of N,N-dimethyl-aminoethanol or N(3-hydroxypropyl)N'-methyl-piperazine methacrylate or a mixture thereof.

The present invention further provides a process for preparing the multifunctional additive of general formula (I). The process consists of copolymerizing a mixture of $R_a$, $R_b$ and $R_c$ (meth)acrylates, the $R_a$ (meth)acrylate being present to the extent of 80–95%, the $R_b$ (meth)acrylate to the extent of 0–12% and the $R_c$ (meth-)acrylate to the extent of 2–8% by weight.

In the preferred embodiment of the present invention the copolymerized mixtures consist of:

85–90 wt % of $R_a$ (meth)acrylates, i.e. (meth)acrylic esters of mixtures of natural or synthetic linear or branched primary alcohols with between 10 and 20 carbon atoms, 3–7 wt % of $R_b$ (meth)acrylates, i.e. (meth)acrylic esters of methanol, $R_c$ (meth)acrylates, i.e. (meth)acrylic esters of 2,2,6,6-tetramethyl-piperidin-4-ol or 50–85 wt % of 2,2,6,6-tetramethyl-piperidin-4-ol methacrylate, the remaining 15–50 wt % consisting of N,N-dimethylaminoethanol (meth)acrylate or N-(3-hydroxypropyl)-N'-methylpiperazine, or a mixture thereof.

The total of $R_c$ (meth)acrylates is 4–6 wt % of the overall (meth)acrylate mixture.

The present invention also provides a new acrylate or methyl acrylate of general formula:

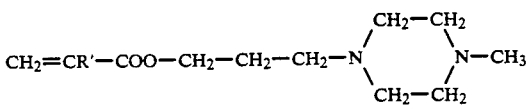

(II)

where R' is hydrogen or methyl, which pertains to the $R_c$ (meth)acrylate class and is hence useful as a dispersant action monomer when copolymerized with other acrylates or alkyl acrylates, it being prepared by usual organic chemistry reactions. To effect polymerization, these monomers are degassed, either separately or together, then mixed and diluted with an inert organic solvent, preferably mineral oil (such as Solvent Neutral 5.4 cSt at 100° C.). The reaction mixture is then heated in the absence of oxygen to a temperature of 70°-130° C., in the presence of a radical initiator (added either before or after heating), until 60-100% of the (meth)acrylic esters have been transformed into the relative copolymer. Radical catalysts suitable for this purpose are generally chosen from tert-butyl-peroctoate, tert-butyl-per(2-ethyl) hexanoate, tert-butyl-per-isononanoate, tert-butylperbenzoate, azo-bis-isobutyronitrile, dibenzoylperoxide, dilauroylperoxide and bis(4-tert-butylcyclohexyl) peroxydicarbonate, and are used in a quantity of between 0.2 and 3 parts by weight per 100 parts of methacrylic esters.

Sulphurated substances such as aliphatic mercaptans, thioglycols and thiophenols (such as tert-dodecylmercaptan and ethanedithiol) may be present in the reaction mixture, their purpose being to regulate the molecular weight of the copolymer. These sulphurated substances generally exhibit their activity when present in a quantity of between 0.01 and 0.5 parts by weight per 100 parts by weight of the (meth)acrylic esters. The progress of the reaction can be monitored by infrared analysis. The monomer conversion generally reaches the stated value within a time of between 0.5 and 4 hours for the aforestated temperatures and other conditions. In this manner a solution of the additive of general formula (I) in an inert solvent is obtained. The copolymer may be isolated as such by removing the solvent by known methods (such as under reduced pressure).

The additive can be added as such to the lubricating oil, but its addition is preferably facilitated by using a concentrate containing 25-95% by weight, and preferably 40-70%, of the additive dissolved in a solvent-diluent, which in a preferred embodiment of the present invention can be the same mineral oil as that used as the inert solvent for preparing the additive of formula (I).

The present invention also provides a lubricating oil composition containing mainly lubricating oil plus a quantity of the described additive effective as a V.I.I., dispersant and antioxidant. This effective quantity is generally between 0.5 and 10%, and preferably between 1.2 and 6% by weight, with respect to the polymer as such. The additive of the present invention can be used in finished lubricants (for example for automotive use) in combination with other usual additives such as dispersants, detergents, antiwear agents, antioxidants etc. The following examples are given to illustrate the present invention.

EXAMPLE 1

148 g of SN 150 mineral oil, 130.31 g of $C_{12}$-$C_{18}$ linear methacrylic alcohol monomers and 1.7 g of 2,2,6,6-tetramethylpiperidin-4-ol methacrylate are fed into a reactor with a diathermic oil heating jacket and fitted with an anchor stirrer, a thermocouple for temperature measurement and a nitrogen injector, and the system is left stirring for one hour while injecting nitrogen. While the reaction is proceeding, 5 g of N-(3-hydroxypropyl)-N'-methyl-piperazine methacrylate, 15 g of methyl methacrylate and 0.9 g of tert-butylperoctoate (TBPO) as polymerization initiator are degassed separately. The degassed monomers are then added to the reactor, its temperature raised to 100° C. and the initiator added. Polymerization commences immediately and is strongly exothermic, the temperature control system therefore being set to maintain this temperature constant until the reaction is complete (2-3 hours). The progress of the reaction is followed by I.R. analysis, the progressive disappearance of the bands relative to the double methacrylic monomer bond at 1320-1340 $cm^{-1}$ being noted. The final solution of the polymer in SN 150 has a kinematic viscosity of 783.83 cSt at 100° C.

Evaluation of the additive as a viscosity index improver

Kinematic viscosity of a 10% solution in SN 150 at 100° C.: 14.77 cSt.

Kinematic viscosity of a 10% solution in SN 150 at 40° C.: 84.74 cSt.

Kinematic viscosity of a 10% solution in SN 150 at −20° C.: 2900 cP.

Viscosity index: 184.

Evaluation of dispersant properties

The dispersant properties of the additive are evaluated by the so-called asphaltene test.

Asphaltenes are produced by oxidation of naphthenic oils in the presence of cupric naphthenate as catalyst. The test method is as follows: 50 mg of the copolymer of which the dispersant properties are to be measured are made up to 20 g with SN 150 under slight heating and stirring. A solution consisting of 30 mg of asphaltenes dissolved in 10 ml of methylene chloride is prepared separately and is added to the dissolved polymer. The solution is placed in an oven at 150° C. for one hour to remove volatile substances and is then allowed to cool. It is transferred into a turbidimeter cuvette and the turbidity value read from the instrument, this value increasing with decreasing dispersant capacity of the polymer. After the first reading the solution is centrifuged at 7500 rpm for 10 minutes, and then a second turbidimeter reading is taken. The dispersion index is given by the equation: D.I.=(turbidity after centrif./turbidity before centrif.)×100.

The absolute turbidity values also constitute a factor of merit so that for equal D.I. values an additive which gives lower absolute turbidity is preferred.

The dispersion index of the copolymer prepared in this manner was found to be 100, the absolute turbidity values being 25/25. A commercial comparison additive gave a dispersion index of 100 and an absolute turbidity of 73/73.

Evaluation of antioxidant properties

20% solutions of the additive in SN 450 containing 0.38% of ferric naphthenate as oxidation catalyst were used. The solution obtained is temperature controlled at 165° C. and kept in air flowing at a rate of 16.5 liters/h. Samples are taken at hourly intervals and are tested for increase in IR oxidation band absorbance at 1700 $cm^{-1}$. The results are compared with those for oil samples without additive. The results were as follows:

Sample without additive

IR absorbance after 2 hours=14.59; after 20 hours=83.93.

Sample with additive

IR absorbance after 2 hours=13.26; after 20 hours=65.99. Again to evaluate the antioxidant properties of the prepared additive, differential thermal analysis was used to determine the onset temperature of the exothermal peak corresponding to substrate oxidation. The analyses were carried out on 20% solutions of polymer in SN 450 containing 0.38% of ferric naphthenate operating with oxygen at 10 bar and with a heating rate of 5° C./min over a 50°-350° C. range. The oil without additive had an onset temperature of 174.7° C. and the oil with additive an onset temperature of 180.2° C.

Engine tests

To evaluate the engine properties of the polymer A obtained in Example 1, a SAE 15W50 grade lubricant was used containing 6.5 wt % of the polymer under examination and 10.5 wt % of conventional additives consisting of a zinc dithiophosphonate, a superbasic calcium sulphonate, a polyisobutenyl succinimide and a sterically hindered phenol. 6.5% of a conventional viscosity index improver based on ethylene-propylene copolymers was also used. The engine tests used for evaluating the lubricant performance were: VE sequence (ASTM STP 315H PTIII procedure), IIIE sequence (ASTM STP 315H PTII procedure), Mercedes M102E black sludge test (CEC L-41-T-88 procedure) and Petter W1 (CEC L-02-A-78 procedure). It is well known that these tests, incorporated into official CCMC specifications, evaluate the dispersant and antioxidant performance of the lubricant and are considered to have been satisfied if the results of the evaluation of the various engine components at the end of the test fall within the limits stated in the specification.

The results of the tests on the described lubricant and the respective limiting values of the CCMC specification for class G4 lubricants are given in the following tables.

TABLE 1

| VE SEQUENCE | Results with additived oil | Specification limit |
|---|---|---|
| Average engine sludge | 9.14 | 9 min |
| Rocker arm cover sludge | 8.10 | 7 min. |
| Average piston skirt varnish | 6.58 | 6.5 min. |
| Average engine varnish | 6.01 | 5 min. |
| Oil ring clogging, % | 0 | 15 max. |
| Oil screen clogging, % | 2 | 20 max. |
| Compression ring struck, No. | 0 | 0 |
| Cam wear average, microns | 130 | 130 max. |
| Cam wear max. microns | 335.3 | 380 max. |

TABLE 2

| IIIE SEQUENCE | Results with additived oil | Specification limit |
|---|---|---|
| Viscosity increase at 40° C., % | 144 | 300 max. |
| Piston skirt varnish | 8.9 | 8.9 max. |
| Ring land varnish | 3.67 | 3.5 min. |
| Sludge | 9.51 | 9.2 min. |
| Ring sticking | 0 | 0 |
| Lifter sticking | 0 | 0 |
| Cam and lifter wear avg, microns | 9.3 | 30 max. |
| Cam and lifter wear max., microns | 49 | 60 max. |

TABLE 3

| MERC. M102E (BLACK SLUDGE) | Results with additived oil | Specification limit |
|---|---|---|
| Engine sludge merit | 9.3 | 9 min. |

TABLE 4

| PETTER W1 | Results with additived oil | Specification limit |
|---|---|---|
| Bearing weight loss, mg | 19.8 | 25 max. |
| Viscosity increase at 40° C., % | 87 | not specified |

EXAMPLE 2

148 g of SN 150 mineral oil, 125.09 g of $C_{12}$–$C_{18}$ linear methacrylic alcohol monomers and 11.8 g of 2,2,6,6-tetramethylpiperidin-4-ol methacrylate are fed into a reactor with a diathermic oil heating jacket and fitted with an anchor stirrer, a thermocouple for temperature measurement and a nitrogen injector, and the system is left stirring for one hour while injecting nitrogen. 15 g of methyl methacrylate and 0.9 g of tertbutylperoctoate as polymerization initiator are degassed separately. The methyl methacrylate is then added and the reaction mixture temperature raised to 100° C. On reaching this temperature the catalyst is added. Polymerization commences immediately and is strongly exothermic, the temperature control system therefore being set to maintain this temperature constant until the reaction is complete (2-3 hours). The progress of the reaction is followed by I.R. analysis, the progressive disappearance of the bands relative to the double methacrylic monomer bond at 1320-1340 $cm^{-1}$ being noted.

The characteristics of the product obtained are determined as described in Example 1. The results are as follows:

Viscosity undiluted at 100° C.: 1100 cst
Viscosity 10% solution in SN 150 at 100° C.: 13.93 cst
Viscosity 10% solution in SN 150 at 40° C.: 78.92 cst
Viscosity index: 183
Viscosity 10% solution in SN 150 at −20° C.: 3000 cP
Dispersion index: 100%
Absolute turbidity values: 118/118
Oxidation stability:
non-additived oil sample: IR absorbance after 2 hours 14.59 after 20 hours 83.93
oil sample containing 20 wt % polymer:
IR absorbance after 2 hours 7.20; after 20 hours 71.40
Differential thermal analysis: onset temperature = 189.2° C.

EXAMPLE 3

Preparation of N-(3-hydroxypropyl)-N'-methylpiperazine methacrylate

N-(3-hydroxypropyl)-N'-methylpiperazine and methylmethacrylate are introduced in a 1:2 molar ratio into a cylindrical glass reactor with a diathermic oil heating jacket and fitted with an anchor stirrer, a thermocouple for temperature measurement and a distillation column with a reflux head. 0.05% of phenothiazine by weight with respect to the reaction mass is added as polymerization inhibitor together with a basic catalyst such as dibutyltin dilaurate in a molar ratio to the initial alcohol of 1:135. The residual pressure is reduced to 560 mmHg by a vacuum pump connected to the column overhead condenser, and the system temperature is gradually increased to 95° C. The reaction mass boils at this temperature, the methanol-methylmethacrylate azeotrope condensing at the top of the column with a weight composition of 85:15. When the temperature at the top of the column has stabilized at about 54°-55° C., i.e. the azeotrope boiling point, this is withdrawn through a reflux divider, the reaction being progressively urged to completion, its progress being followed by gas chromatography analysis. After about 9 hours, when the converted alcohol exceeds 98%, the excess methyl methacrylate, the unreacted alcohol and any methanol still present are removed by high vacuum distillation, and the methacrylate obtained in this manner is distilled.

boiling point: 116° C./2 mmHg yield after distillation; 95% analysis by elements (theoretical values in parentheses): C=63.4 (63.6); H=10.1 (9.8); N=12.1 (12.3)

I.R. (liquid film): characteristic absorption at 1720 $cm^{-1}$ (carbonyl group) and at 1640 $cm^{-1}$ (C=C double bond).

We claim:

1. A polymeric viscosity index improvement additive with dispersant and antioxidant properties and consisting essentially of, by weight, 80-95% of the units (A), 1-9% of the units (B) and 2-8% of the units (C):

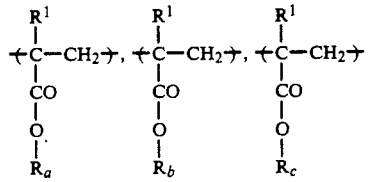

where:

$R^1$, which is the same or different, is hydrogen or an alkyl radical;

$R_a$ is an alkyl radical or a mixture of linear or branched alkyl radicals with from 6 to 25 carbon atoms;

$R_b$ is an alkyl radical with from 1 to 4 carbon atoms or is identical to $R_a$; and $R_c$ is one or more linear, branched or cyclic radicals containing 1 or 2 nitrogen atoms and 4 to 20 carbon atoms.

2. A polymeric viscosity index improvement additive with dispersant and antioxidant properties and consisting essentially of, by weight, 85-90% of the units (A), 3-7% of the units (B) and 4-6% of the units (C):

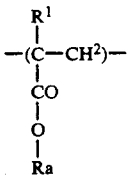

(A)

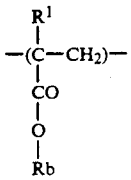

(B)

-continued

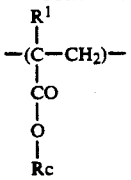

(C)

wherein $R^1$ is methyl; Ra represents alkyl groups derived from mixtures of natural or synthetic linear or branched primary alcohols with between 10 and 20 carbon atoms; Rb is methyl and Rc is the radical of 2,2,6,6-tetramethyl-piperidin-4-ol.

3. A polymeric viscosity index improvement additive with dispersant and antioxidant properties and consisting essentially of, by weight, 80-95% of the units (A), 0-12% of the units (B) and 2-8% of the units (C):

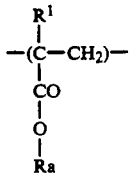

(A)

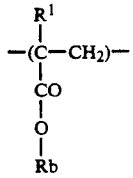

(B)

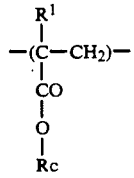

(C)

where:

$R^1$, which is the same or different, is hydrogen or an alkyl radical;

Ra is an alkyl radical or a mixture of linear or branched alkyl radicals with from 6 to 25 carbon atoms;

Rb is an alkyl radical with from 1 to 4 carbon atoms or is identical to Ra;

Rc is one or more linear, branched or cyclic radicals containing from 1 or 2 nitrogen atoms and 4 to 20 carbon atoms; and wherein the units (C) are derived from a mixture of 50-85 wt % of 2,2,6,6-tetramethyl-piperidin-4-ol methacrylate and 15-50 wt % of N,N-dimethylaminoethanol or N-(3-hydroxypropyl)-N'-methylpiperazine methacrylate.

4. A lubricating oil concentrate containing 25-95% by weight, of the additive of claim 1, 2, or 3 in a solvent-diluent.

5. A lubricating oil composition containing mainly lubricating oil plus a quantity of the additive claimed in claim 1, 2, or 3 which is effective as a viscosity index improver, dispersant and antioxidant.

6. The composition of claim 5, wherein the viscosity index improvement additive with dispersant and antioxidant properties is present in a quantity of between 0.5 and 10% by weight.

7. A lubricating oil concentrate according to claim 4, containing 40-70% by weight of the additive.

8. A lubricating oil concentrate according to claim 7, wherein the solvent-diluent is mineral oil used in the preparation of the additive.

* * * * *

UNITED STATES PATENT AND TRADEMARK OFFICE

CERTIFICATE OF CORRECTION

PATENT NO. : 5,322,632

DATED : June 21, 1994

INVENTOR(S) : Paola Gambini, Paolo Koch and Alberto Santambrogio

It is certified that error appears in the above-indentified patent and that said Letters Patent is hereby corrected as shown below:

On the title page of the Patent, under the heading "[73] Assignee", it should read as --Ministero Dell 'Universita' E Della Ricerca Scientifica E Tecnologica--.

Signed and Sealed this

Twenty-fifth Day of October, 1994

*Attest:*

*Attesting Officer*

Bruce Lehman

BRUCE LEHMAN

*Commissioner of Patents and Trademarks*